US010272291B2

(12) United States Patent
Santos et al.

(10) Patent No.: US 10,272,291 B2
(45) Date of Patent: Apr. 30, 2019

(54) KNEE FLEXION AND EXTENSION THERAPY DEVICE AND METHOD OF USE

(71) Applicants: Allan J. Santos, Lexington, KY (US); Layne C. Santos, Lexington, KY (US)

(72) Inventors: Allan J. Santos, Lexington, KY (US); Layne C. Santos, Lexington, KY (US)

( * ) Notice: Subject to any disclaimer, the term of this patent is extended or adjusted under 35 U.S.C. 154(b) by 0 days.

(21) Appl. No.: 15/330,739

(22) Filed: Oct. 31, 2016

(65) Prior Publication Data

US 2017/0128775 A1 May 11, 2017

Related U.S. Application Data

(60) Provisional application No. 62/285,530, filed on Oct. 30, 2015.

(51) Int. Cl.
*A63B 21/00* (2006.01)
*A63B 21/002* (2006.01)
(Continued)

(52) U.S. Cl.
CPC .... *A63B 23/0494* (2013.01); *A63B 21/00069* (2013.01); *A63B 21/015* (2013.01); *A63B 21/4034* (2015.10); *A63B 21/4039* (2015.10); *A63B 21/4045* (2015.10); *A63B 22/203* (2013.01); *A63B 23/03508* (2013.01); *A63B 24/0087* (2013.01); *A63B 71/0622* (2013.01); *A63B 21/0023* (2013.01); *A63B 23/03525* (2013.01); *A63B 2022/0094* (2013.01); *A63B 2023/006* (2013.01); *A63B 2071/063* (2013.01); *A63B 2071/0655* (2013.01); *A63B 2071/0694* (2013.01); *A63B 2208/0233* (2013.01); *A63B 2208/0252* (2013.01); *A63B 2209/10* (2013.01);
(Continued)

(58) Field of Classification Search
CPC ..... A63B 21/00069; A63B 21/4045; A63B 21/4034; A63B 21/4039; A63B 23/0494; A63B 24/0087; A63B 71/0622; A63B 2220/56; A63B 23/08; A63B 22/20–22/203
See application file for complete search history.

(56) References Cited

U.S. PATENT DOCUMENTS 2,720,396 A * 10/1955 Pfaus ..... A63B 23/03533 482/130
4,492,222 A 1/1985 Hajianpour
(Continued)

*Primary Examiner* — Jennifer M Deichl
(74) *Attorney, Agent, or Firm* — Carrithers Law Office, PLLC

(57) ABSTRACT

A portable exercise apparatus including an exercise board with moving and fixed indices marking progress made while exercising a knee which requires therapy consisting of controlled flexing and extending of the knee joint. A foot board or seated foot slide cooperatively engages and slides back and forth on the exercise board. An knee/ankle platform is removably attachable to the seated foot slide providing for active or passive knee extension stretching and a short-arc quad. A knee extension pad and target is included for use with the platform. Sensing means which may include a microprocessor control box or computer or smart device with a light and/or sound device for visual and/or auditory feedback are in communication with the exercise board provide a user with the results of flexing or extending the knee by a selected controlled amount.

22 Claims, 8 Drawing Sheets

(51) Int. Cl.

| | |
|---|---|
| ***A63B 21/015*** | (2006.01) |
| ***A63B 22/00*** | (2006.01) |
| ***A63B 23/00*** | (2006.01) |
| ***A63B 23/035*** | (2006.01) |
| ***A63B 23/04*** | (2006.01) |
| ***A63B 24/00*** | (2006.01) |
| ***A63B 71/06*** | (2006.01) |
| ***A63B 22/20*** | (2006.01) |

(52) U.S. Cl.

CPC ..... *A63B 2210/00* (2013.01); *A63B 2220/13* (2013.01); *A63B 2220/17* (2013.01); *A63B 2220/20* (2013.01); *A63B 2220/53* (2013.01); *A63B 2220/56* (2013.01); *A63B 2220/80* (2013.01); *A63B 2220/803* (2013.01); *A63B 2225/09* (2013.01); *A63B 2225/50* (2013.01)

(56) References Cited

U.S. PATENT DOCUMENTS

| | | | | |
|---|---|---|---|---|
| 4,520,827 | A | 6/1985 | Wright et al. | |
| 4,558,692 | A | 12/1985 | Greiner | |
| 4,603,687 | A | 8/1986 | Greenwood | |
| 4,637,379 | A | 1/1987 | Saringer | |
| 4,922,892 | A | 5/1990 | Akcelorod et al. | |
| 4,930,497 | A | 6/1990 | Saringer | |
| 5,529,573 | A | 6/1996 | Kelly et al. | |
| 6,217,532 | B1 | 4/2001 | Blanchard et al. | |
| 6,224,521 | B1 | 5/2001 | Foucault | |
| 6,267,735 | B1 | 7/2001 | Blanchard et al. | |
| 7,175,602 | B2 | 2/2007 | Diaz et al. | |
| 7,309,320 | B2 | 12/2007 | Schmehl | |
| 7,833,178 | B2 | 11/2010 | Lee et al. | |
| 9,474,675 | B2 * | 10/2016 | Hansen | A61H 1/008 |
| 9,526,945 | B1 * | 12/2016 | Edmondson | A63B 23/0494 |
| 2003/0120186 | A1 | 6/2003 | Branch et al. | |
| 2004/0049135 | A1 | 3/2004 | Callanan et al. | |
| 2009/0163837 | A1 | 6/2009 | Sanger et al. | |
| 2010/0204620 | A1 | 8/2010 | Smith et al. | |
| 2014/0031175 | A1 * | 1/2014 | Peralo | A61H 1/02 482/66 |
| 2014/0088466 | A1 * | 3/2014 | Hansen | A61H 1/008 601/34 |

* cited by examiner

KNEE FLEXION AND EXTENSION THERAPY DEVICE AND METHOD OF USE

CROSS REFERENCES TO RELATED APPLICATIONS

This application claims priority from U.S. Provisional Application Ser. No. 62/285,530 filed Oct. 30, 2015 and which is incorporated herein in its entirety.

TECHNICAL FIELD

The present invention relates to the field of devices which facilitate knee exercises meant to improve the range of motion and flexibility of the knee joint.

BACKGROUND OF THE INVENTION

When a patient has had knee surgery, especially knee replacement surgery, suggested exercises for improving the range of motion of the knee include extending and bending the knee over and over again. After surgery, the knee joint is stiff and painful to move. The joint will remain stiff until such exercises are performed regularly. Common knee exercises include performing isometric exercises consisting of manually moving the limb to be treated, while performing thrusts or counter thrusts in order to force the muscles of the limb to work and thus restore their initial flexibility, shape and quality. Exercises including flexing of the joint can give good results. However, this method of recuperation suffers from the major drawback of requiring action by a practitioner, e.g. a physiotherapist, whose professional qualifications are not essential for performing this work. A preferred exercise aid would allow a patient to exercise on his own and the patient should be able to easily and accurately measure improvement of joint motion, strength and flexibility.

Slow, continuous flexing of a joint, such as the knee, following surgery on that joint will promote rapid healing, reduce pain during healing and result in an increased range of motion of the joint. Devices for the continuous passive exercising of limbs for therapy, rehabilitation or healing often include a frame which cradles the leg within it, while the frame is driven slowly up and down with an electric motor and drive screw. This has caused difficulty as it is sometimes preferable to have the leg in a near horizontal position when it is straight. Setting and controlling the angle of flex is difficult with a frame type device.

DESCRIPTION OF THE RELATED ART

U.S. Pat. No. 4,922,892 by Akcelrod for APPARATUS FOR RESISTIVE EXTENSION AND FLEXION OF THE LEG which issued on May 8, 1990 teaches a device including an articulating frame with receivers for holding and supporting a user's leg while the suer tries to repeatedly straighten and bend the leg. The frame is slidably mounted on a panel and includes springs which provide resistance during the exercise.

US Patent Application Publication No. 20100204620 teaches a therapy and mobility assistance system used by a patient that includes a leg device worn on the leg of the patient that provides assistance and/or resistance to enhance the mobility of the leg of the patient.

SUMMARY OF THE INVENTION

In accordance with the present invention, there is provided a knee exercise system comprising, consisting of, or consisting essentially of a generally rectangular slide board having a front end, a rear end, and an upper flat surface with a pair of marginal walls forming a lip or rim extending upwards from two longer sides of the generally rectangular slide board. The upward extending marginal walls have outer vertical sides which include a horizontal longitudinal T-shaped slot with two movable target indices slidably engaged in each. The upward extending marginal walls also have fixed index marks near the rear end of the generally rectangular slide board for aligning the slide board with a user's chair. The knee exercise system also includes a generally rectangular foot board slidably captured between the upward extending marginal walls of the slide board. Also included is a movable pointer slidably captured between the upward extending marginal walls of the generally rectangular slide board. The movable pointer is placed at a rear end of the foot board. There is a knee/ankle support including a base, a vertical tower and a knee/ankle supporting pad affixed to a top of the tower of selected effective height of less than the height of a knee bent with the foot and hip of the user resting horizontally on a surface. The base includes downward extending lugs. The selected height of one of the tower provides for variable vertical extension between the underside of the knee and support surface. For example, layered pads or one or more blocks of from about 3 to 12 inches, more preferably from 5 to 10 inches an typically about 7 inches is an appropriate thickness. The foot board has a top surface capable of supporting a foot of a user and slots capable of receiving and cooperatively engaging the downward extending lugs of the knee/ankle support. The present invention includes knee extension pads and two height extending pads wherein each of the knee extension pads are four tenths to six tenths of an inch thick.

The knee flexion therapy exercise device focuses on improving the knee range of motion after undergoing knee arthroplasty for promoting active effort of the patient. It promotes patient compliance with home exercises by providing a visual incentive with flexion target and extension target to monitor their progress and decreases the formation scar tissue which accumulates during healing unless the muscles are stretched and exercised by therapy. It facilitates the performance of key conventional exercises needed to achieve from 50 to 80 degree knee extension and from 0 to 110 degree or greater knee flexion especially during the acute and subacute phases of knee rehabilitation.

It is an object the present invention to provide a sliding base featuring a flexion pointer and flexion target (multilayer or level tower of platform) to provide visual incentive to achieve knee flexion goal wherein the flexion target can be moved close to or farther from the proximal end to set a goal and a method of measurement and calibration in order to show incremental stages of improvement.

It is an object the present invention to provide three layers of detachable extension target to provide visual and tactile incentives to achieve a knee extension goal.

It is an object the present invention to provide an exercise device wherein tension of the sliding foot board can be adjusted to add resistance for strengthening of the hamstrings.

It is an object the present invention to provide an ankle platform for static passive and active stretching providing continuous passive motion ("CPM") movement toward terminal knee extension wherein the platform rests on the sliding board for firm support and the platform can be used as a knee platform to perform short arc quads for quadriceps strengthening.

It is an object the present invention to provide, a exercise device providing a visual incentive.

It is an object the present invention to provide an exercise device which is lightweight and can be easily carried by the patient from the bed to the floor.

It is an object the present invention to provide an exercise device which can be used in all settings of rehabilitation including acute care, inpatient rehab, skilled nursing facility home health care, and out-patient physical therapy clinics and optionally with wireless digital goniometer.

It is an object of this invention to provide a knee exercise device which enables a patient to sit in a chair, place the foot of the injured knee on a food board, and slide the foot board forward and back to perform repetitive straightening and bending motions of the knee.

It is an object of this invention to provide a knee exercise device which provides the user with a movable pointer which measures results and notes improvements during exercise by marking the position that a user was able to move the foot board and thus giving a measure of how much the user was able to flex the knee joint.

It is an object of this invention to provide a knee exercise device which provides the user with movable target indices for marking immediate and future exercise goals.

It is an object of this invention to provide a knee exercise device which provides audible and visual feedback in the form of a light and a bell or buzzer which activates when the movable pointer moves next to the movable target index which marks the immediate goal.

It is an object of this invention to provide a knee exercise device which provides a knee/ankle support device upon which the ankle or the knee is supported and which facilitates exercises for straightening the knee joint.

It is an object of this invention to provide a knee exercise device which provides a variable thickness extension pad with an internal pressure sensor which is placed under the knee joint of a patient lying on his back and wherein the pressure switch causes a light and or buzzer to activate when the user is able to press down on the sensor pad with enough force.

It is an object of the present invention to provide a portable knee board for isokenetic exercise.

Other objects, features, and advantages of the invention will be apparent with the following detailed description taken in conjunction with the accompanying drawings showing a preferred embodiment of the invention.

BRIEF DESCRIPTION OF THE DRAWINGS

A better understanding of the present invention will be had upon reference to the following description in conjunction with the accompanying drawings in which like numerals refer to like parts throughout the views wherein.

DESCRIPTION OF THE PREFERRED EMBODIMENTS

Figure 1:
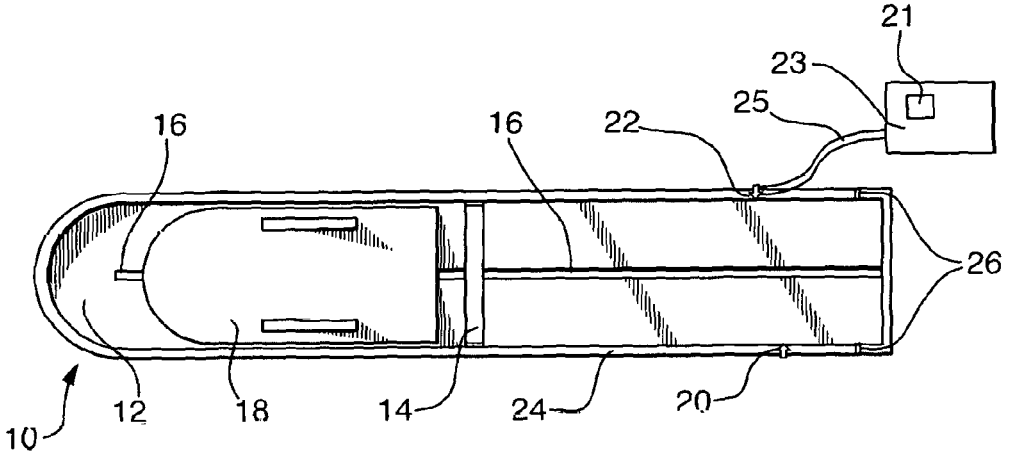
FIG. 1 is a top view of the knee exercise slide board and seated foot slide, movable pointer device, and movable target indices.
Figure 19:
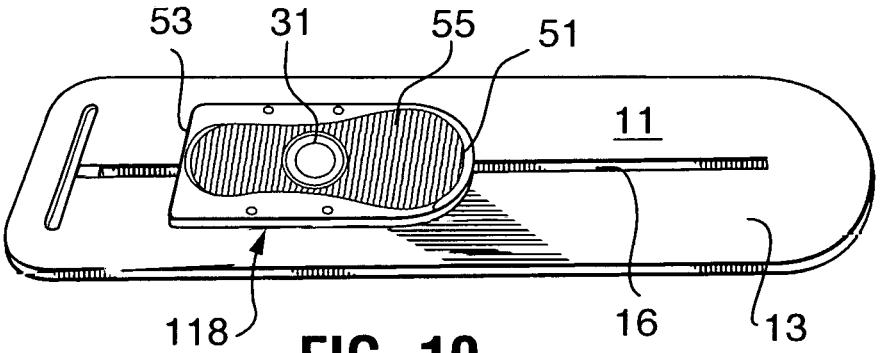
FIG. 19 is a perspective view showing s a slide board slidably attaching to a slide board base with an adjustable tension knob disposed within a recess in the slide board surface.

In accordance with the present invention as shown in FIGS. 1-19, there is provided a knee exercise apparatus 10. The knee exercise apparatus 10 including a generally rectangular knee exercise slide board base 12. As best shown in FIGS. 1-2, and 19-20 the slide board base comprises a generally flat rectangular board 12. The front portion can include a curved or parabolic shaped front end 6 connecting spaced apart side edges 7 and a straight rear end edge 8. Longitudinal means for guiding comprising at least one ridge, slot, groove, or plurality of slots or grooves 16 is cut or formed through or into a the top surface 11 of the slide board base 12. A guide means such as a rail or lip 3 can extends around the periphery of the slide board forming a track 13 as shown in FIGS. 1 and 19 comprising a raised peripheral rim extending upward along the outer edge of the slide board base 12. Optionally, a relief an be formed in the slide board base 12 by molding the board from a plastic material or removing material from a wood board in order to form a trough extending the length of the slide board base 12. The slide board base 15 shown in FIG. 21 does not include the optional track 13 feature.

A generally rectangular slidable foot board 18, 118 is supported by and in slidable cooperative engagement with the surface 11 of the slide board 12. As shown in FIGS. 1 and 19 the slidable foot board is disposed within the track resting horizontally on said flat upper surface of the slide board. The movable foot board 18, 118 includes means for slidable cooperative engagement with the slide board 12.

Figure 20:
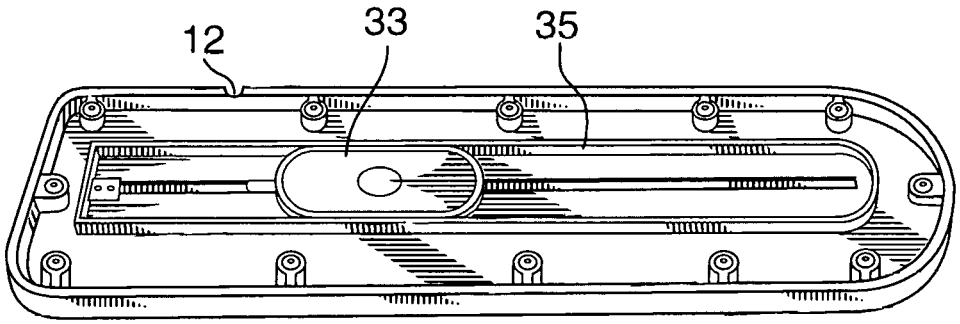
FIG. 20 is a perspective view of the underside of the slidable board base on FIG. 19 and the tab sliding along the bottom track and cooperatively engaging the tension knob holding the slide board to the slide board base.
Figure 21:
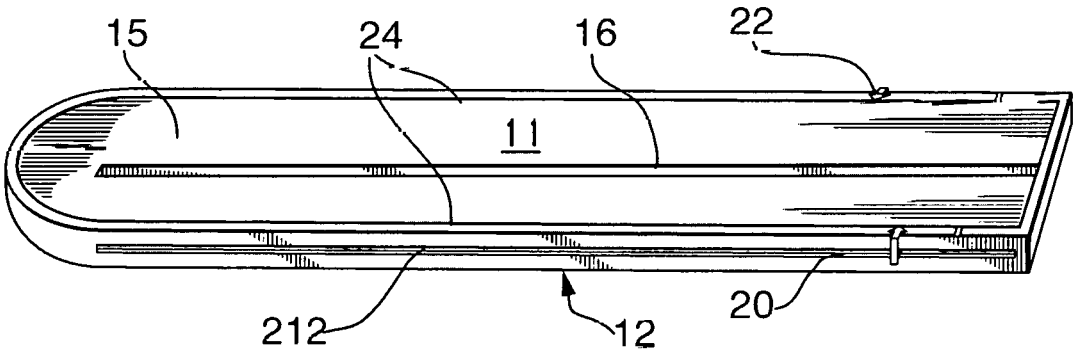
FIG. 21 is a perspective view of a slide base board having a generally flat or slightly depressed surface forming a trough with a longitudinal groove extending along the center portion.

As shown in 19-21, means for enhancing friction between the slide board 18, 118 and slide board base 12 tension comprises a tension knob 31 has a shank having a threaded distal end (not shown) extending through a opening in the slide base 118 and through a receiving means such as a slot 16 in the slide base board 12 for cooperatively engaging slidable fastening means disposed on the bottom of the slide board base 12 comprising a slidable fastener such as wing nut, nut, tab or other holding means having threaded members in order to hold the slide base 118 to the slide board base 12. Rotation of the tension knob tightens the slide board 118 against the slide board base 12 creating friction therebetween and adjustable slidable tension. As best shown in FIG. 20, the slidable fastening means comprises an elongated tab guided by the slot 16 and a bottom rim 35 slidably engaging a tension track extending around the receiving means or slot 16 to secure and guide the tab therein. The slide board 118 shown in FIG. 19 includes a front rim 51 and rear rim 53 and friction enhancing means 55 such as grooves and ridges formed in the surface of the slide board 118. A resilient or soft rubber or elastomer material may also be used to cover at least a portion of the slide board for comfortable friction enhancing means.

Figure 5:
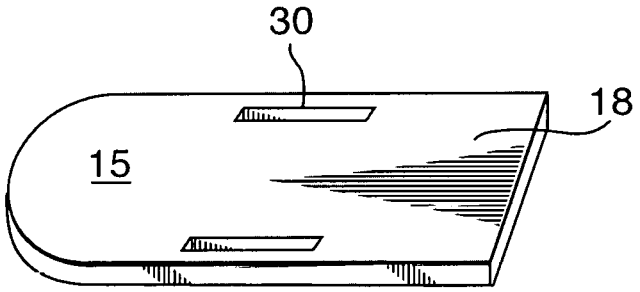
FIG. 5 is a top perspective view of the foot board.
Figure 6:
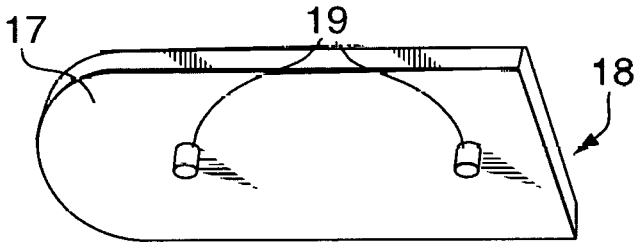
FIG. 6 is a bottom perspective view of the foot board showing the downward extending guide lugs.

The slide board 18 shown in FIG. 1 includes projecting means such as at least one peg 19 extending from a bottom surface 17 of the slide board 18 for cooperatively engaging at least one receiving means such as a medial slot or groove 16 formed in the surface 11 of the slide board base 12. As shown in FIGS. 5 and 6, projecting means such as at least one peg 19 extends from a bottom surface 17 of the slide board 18 for cooperatively engaging at least one receiving means such as a medial slot or groove 161 formed in the surface 11 of the slide board base 12. It is contemplated that a plurality of projecting means can extend from the bottom surface 17 of the slide board cooperatively A movable pointer 14 can be slidably disposed in the groove 16 positioned between the slidable foot board 18 and the rear end 8 of the slide board base. Movable target indices 22 and 20 are mounted in cooperative slidable engagement with the rim 6 or edge of the slide base board 12. Marker and slide board positioning indicia or alignment lines such as hash marks 9 are optionally formed or printed on the slide base board surface or attached to the rim 6 of the side edges 7 between the foot slide 18 and rear end 8 of the slidable board base 18.

Figure 4:
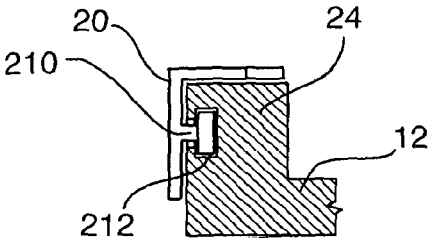
FIG. 4 is a side view of the movable target indices cooperatively engaged in a slot of the slide board.

As best shown in FIG. 4, the movable target indices 22 and 20 include a lug, more specifically a T-shaped lug 210 which is movably captured within a horizontal slot, such as a T-shaped slots 212 along each of the side edges 7 or along the outer rim 6 sides of the slide board base 12. The movable target indices 22 and 20 are slidably captured within the T-shaped slots 212. As the user slides the foot board 18 toward the chair 59 it pushes the movable pointer 14 in the same direction.

The foot board 18 is captured within two parallel upward extending exterior walls 24 on each long side of the slide board 12 defining the lip or peripheral rim 3. It is contemplated that a slide board 18with downward extending lugs 30 can slide within a central elongated slot 16 in the upper surface of the slide board base 12. The movable pointer 14 is also loosely captured between the rim walls 24 of the slide board 12 and is smoothly moved toward the target indices 22 and 20 by contact with the square rear side of the foot board 18. As the user then moves the foot board 18 forward, the movable pointer 14 is left in the rearmost position to which the user was able to move. The movable pointer 14 may include one or more downward extending lugs which guidingly slides within the longitudinal slot 16.

Figure 2:
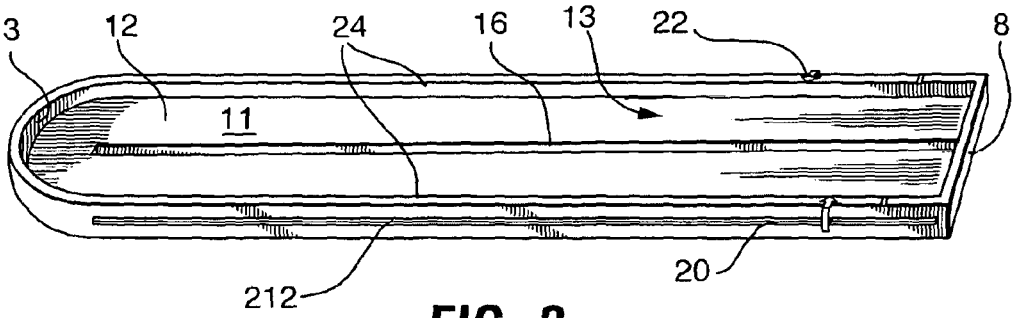
FIG. 2 is a top perspective view of the slide board apparatus showing the groove and outer peripheral rim.

A movable target index 22 can be incorporated within the device to include sensing means such as an electronic sensor 27which senses when the movable pointer 14 comes in close proximity to the movable target index 22 by moving past a limit switch sensor, light sensor, magnetic sensor, voice activated sensor, or motion sensor. The sensor 27 in close proximity to target index 22 is electrically connected to a control box 23 by a cable 25 and causes an alarm means such as a light and/or buzzer to activate as the pointer 14 comes to close proximity with the sensor. It is contemplated that the intensity of the alarm increases as the distance between the sensor 27 and target index 22 decreases. As shown in FIG. 2, movable target sensor 22 is placed at a point that a user considers to be a reasonable target for the present exercise session, while the movable target index 20 is meant to be a target for a later exercise session. The electronic signal is passed to smart device 21 which maybe wireless and may record or show visual data.

Figure 7:
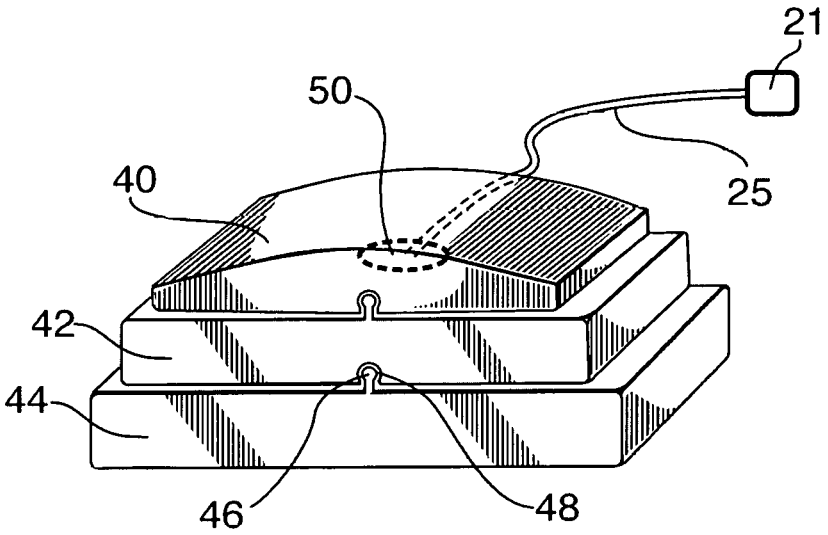
FIG. 7 is a perspective side view of the knee extension sensor pad with multiple stacked height extending layers.
Figure 8:
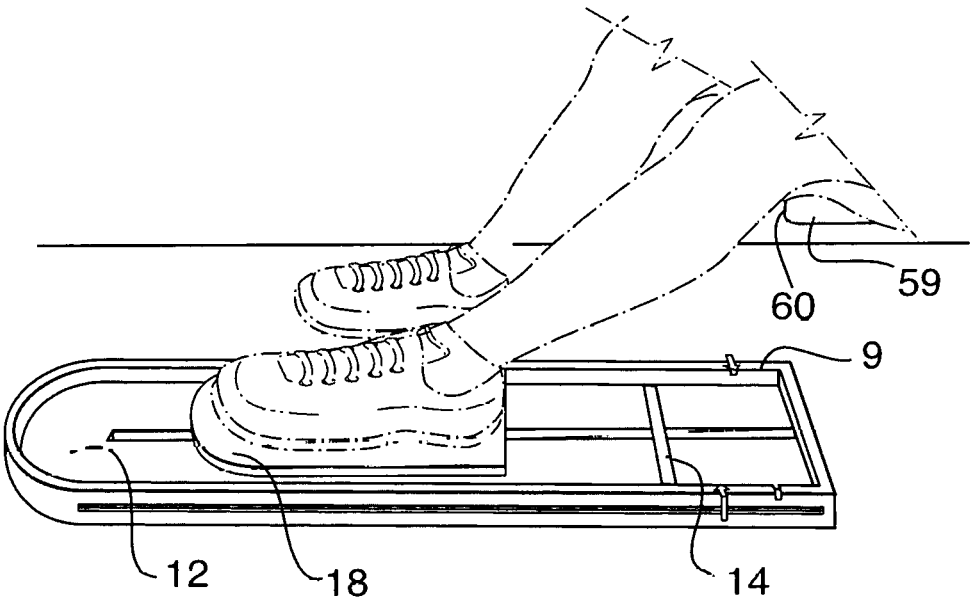
FIG. 8 is a perspective side view of a user sliding the foot board forward.
Figure 9:
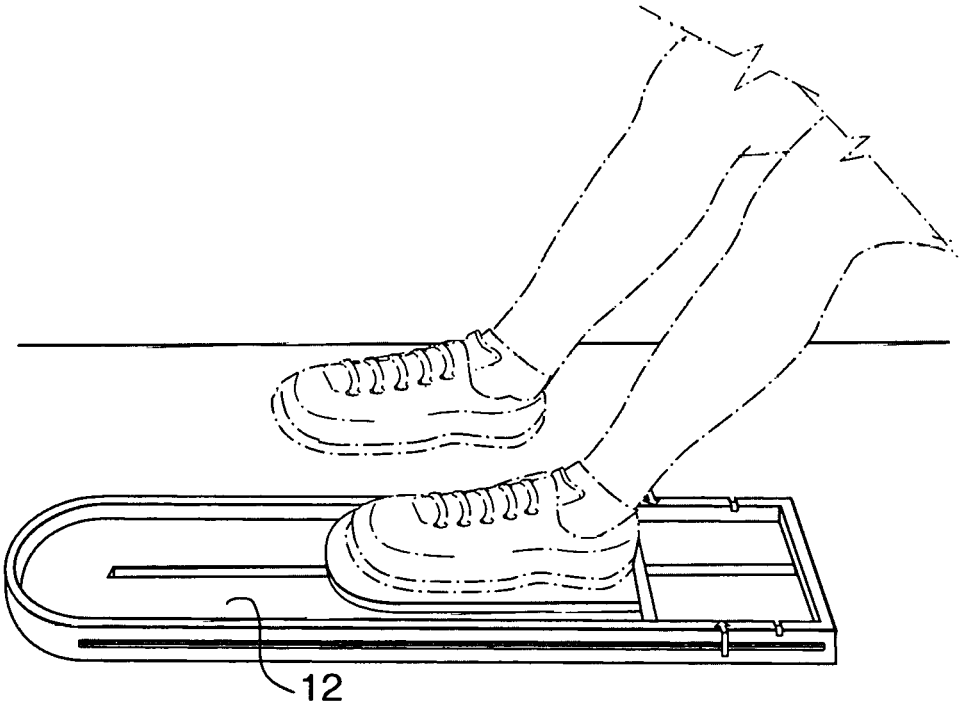
FIG. 9 is a perspective side view of a user pulling the foot board back.

Index marks 26 on either side of the slide board 12 are reference points which help the user to set the position of the exercise board 12 relative to the edge of a chair, for instance with the hash mark about six inches from the edge of the chair in which the user will be sitting, as shown in FIGS. 7-9. The user will sit in the same position on the chair each time he/she exercises. The positioning indica or lines 9 may also be used for aligning the board with a support means for the users such as the front leg or front edge 60 of a seat of a chair 59 as shown in FIG. 8.

Figure 3:
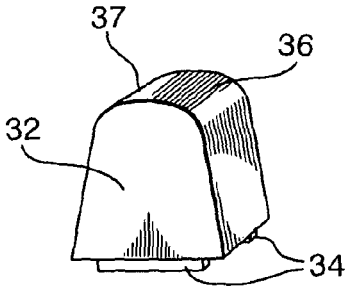
FIG. 3 is a side perspective view of the knee/ankle support.

FIGS. 3, 12-14, and 17 show the knee/ankle support 32. As shown in FIG. 3, the knee/ankle support 32 comprises a vertical tower or platform having a with a slightly curved or convex top surface 36 which may include a pad 37 for gentle support of the knee or ankle. The support 32 cooperatively and slidably engages at least one and preferably two slots, projections, hook and loop material of other holding means to removably fasten the support 32 to a top surface 15 of the sliding board 18.

Figure 17:
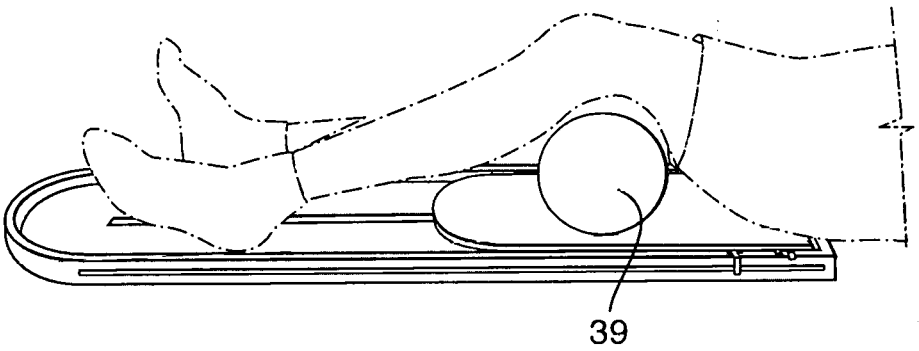
FIG. 17 is a side view of a user resting his knee on a cylindrical knee/ankle support device.
Figure 18:
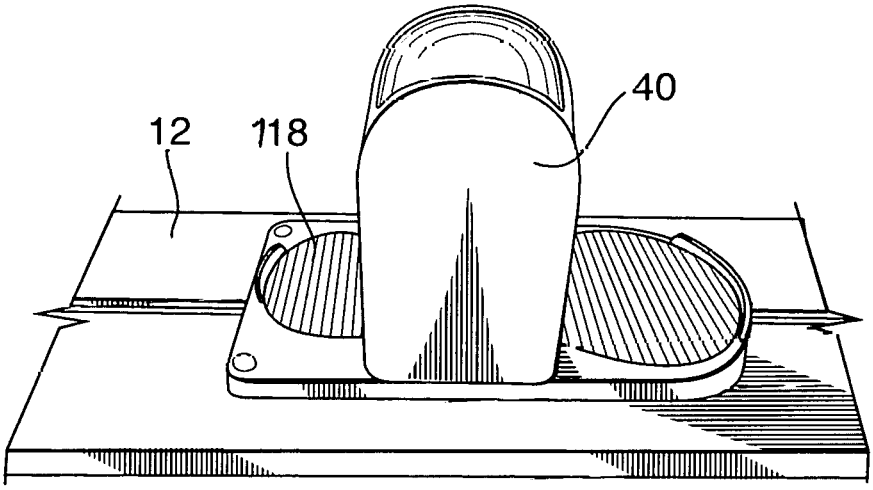
FIG. 18 shows a perspective view of a knee extension pad or spacer removably attachable to the slide board.

As shown in FIGS. 1 and 5, slots 30 cooperatively engage corresponding sized and shaped downward extending lugs 34 which are cooperatively engage within slots 30 in the slide board 18 to securely hold the knee/ankle support onto the foot board. The knee/ankle support 32 is preferably a trapezoidal shape having a parabolic or convex top surface with the long base at the bottom for vertical stability. However, the tower or platform could be shaped as a rectangular box, a cylinder 39 as shown in FIG. 17, or any shape which provides vertical support and stability for a user's knee or ankle during exercise. The knee/ankle support 32 preferably extends up to 12 inches and more preferably from about six and one half to seven inches above the height of the foot board 18.

Figure 10:
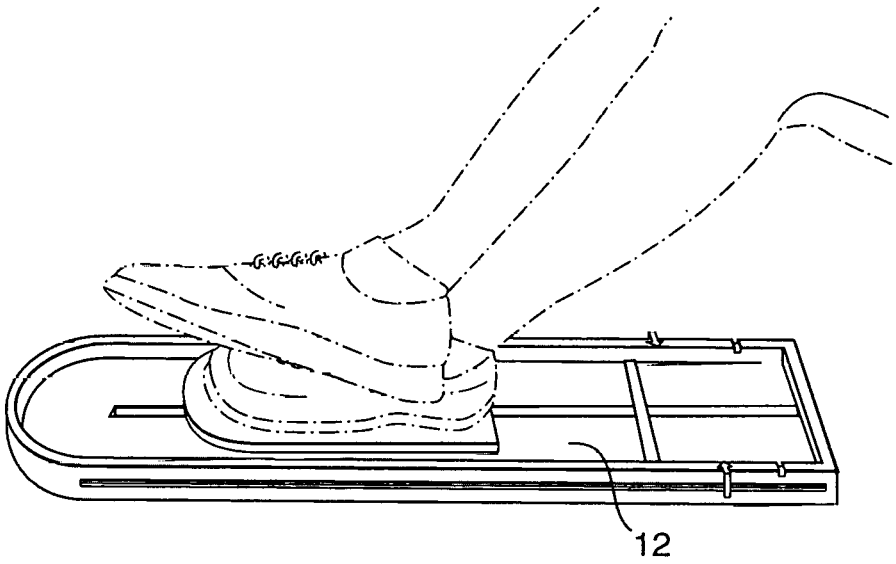
FIG. 10 is a side view of a user helping to move the injured leg back with the uninjured leg.
Figure 11:
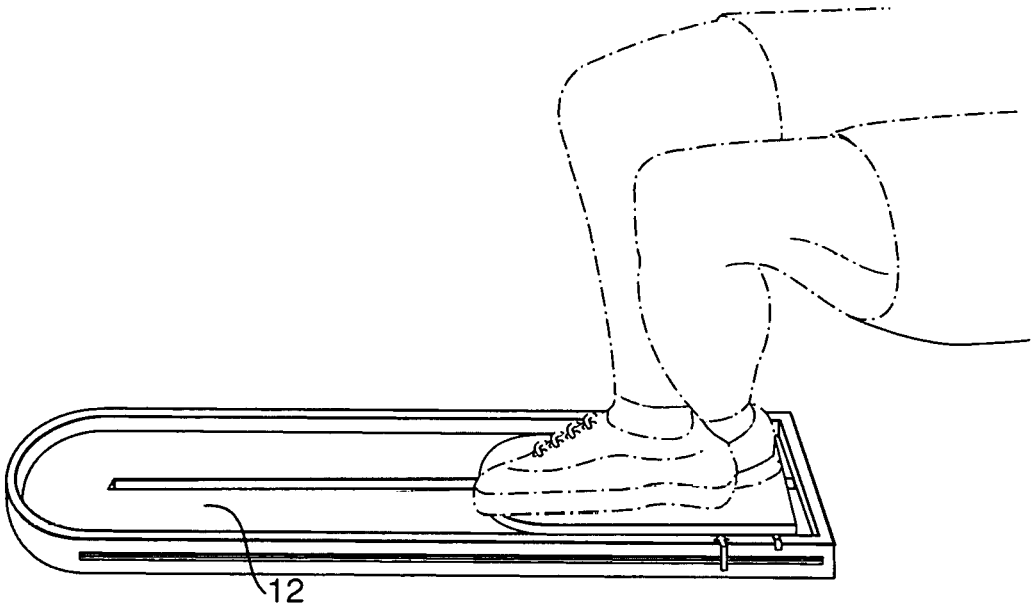
FIG. 11 is a second side view of a user helping to move the injured leg back with the uninjured leg.

As shown in FIGS. 9, 10 and 11 the injured leg is pulled back by the user using the uninjured leg; however, the therapist or other assistant often assists the patient with initial movement during therapy. The friction can be enhanced to stretch and the knee during the backward or forward motion.

Figure 12:
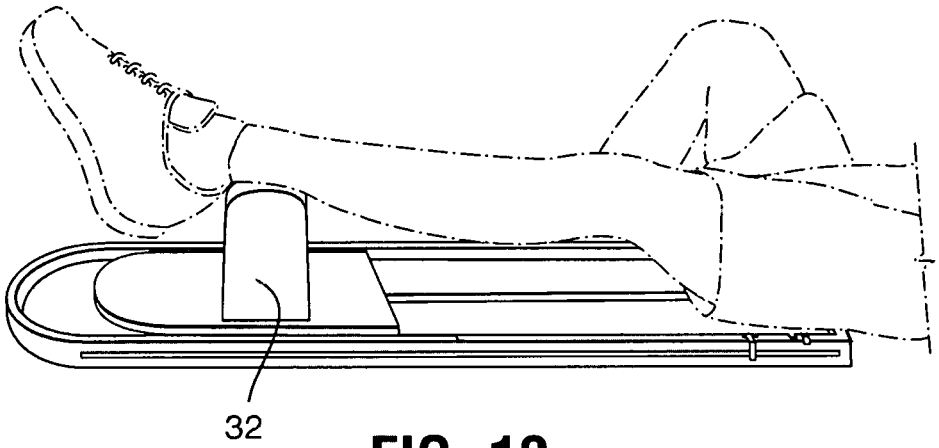
FIG. 12 is a side view of a user resting his ankle on the knee/ankle support device which has been assembled onto the foot board.
Figure 13:
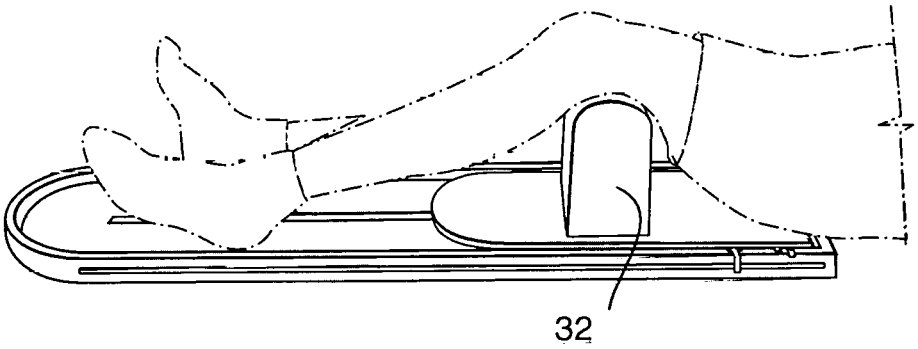
FIG. 13 is a side view of a user resting his knee on the knee/ankle support device.
Figure 14:
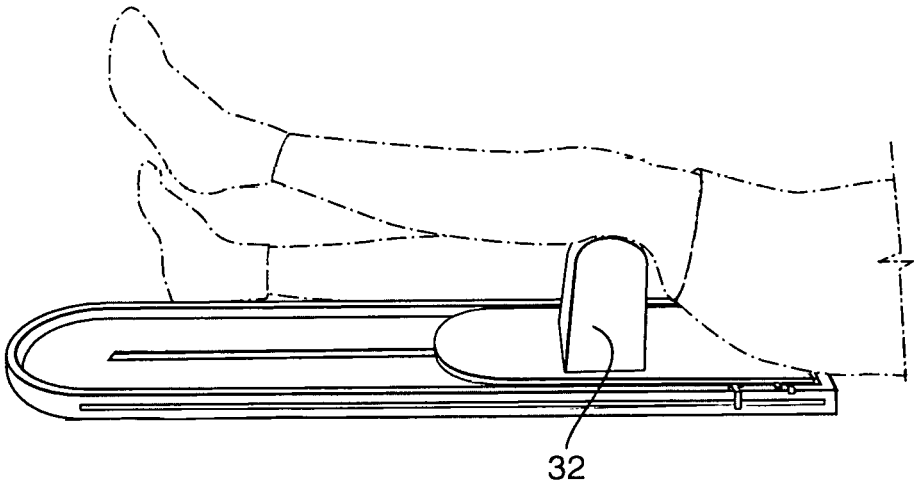
FIG. 14 is a side view of a user supporting his knee on the knee/ankle support device while extending his knee joint to straighten his leg.
Figure 15:
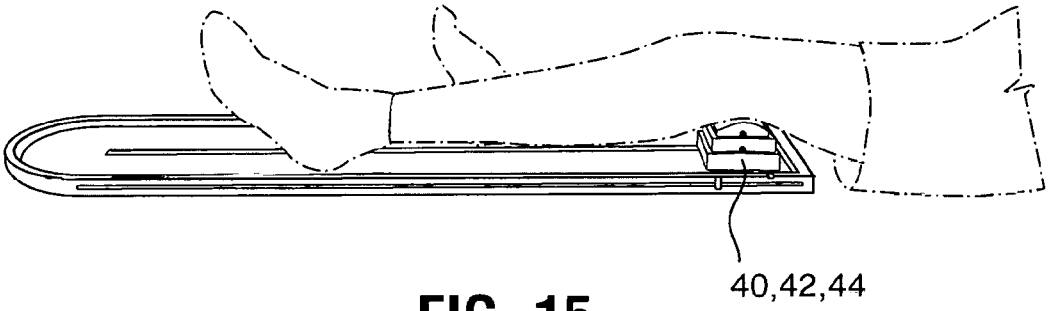
FIG. 15 is a side view of a user supporting his foot on the foot board while extending his knee joint against the knee extension sensor pad with a plurality of height extenders under sensor pad.

As shown in FIG. 12, the user places his ankle on the pad 36 of the knee/ankle support 32 to help straighten his knee joint. In FIGS. 13 and 14, the user has placed the underside of the knee on the pad 36 of the knee/ankle support 32 to help flex the knee joint.

Figure 16:
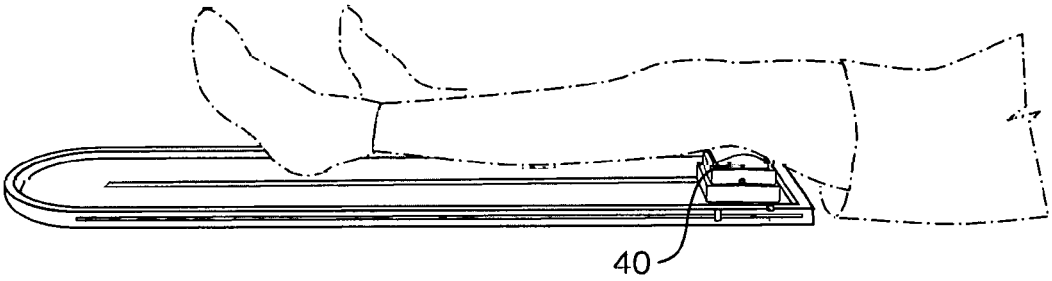
FIG. 16 is a side view of a user supporting his foot on the foot board while extending his knee joint against the knee extension sensor pad without height extenders under sensor pad allowing the knee to extend farther in downward motion.

When exercising the knee by extending the knee joint, a user places the underside of his knee on a knee extension pad or spacer 40, as shown in FIG. 16 which is positioned under the knee of the patient so that the top of the spacer or pad rest beneath the knee to support the leg. When the user touches or to depresses the knee extension pad 40, the user is performing the therapy motion properly. As shown in FIG. 7, the knee extension pad 40 may include an internal pressure sensor 50 which is electrically connected to the control box 23. When the internal pressure sensor 50 senses pressure from the downward pressure of the user's knee, the sensor 27 will activate giving viable and auditory feedback to the user that he has successfully extended his knee. Height extenders 42 and 44 are added to raise the knee extension pad 40 when the user is in the early stages of therapy and as the user is able to more fully extend his knee joint, the height extenders are removed to provide a more difficult extension target. The knee extension sensor pad 40 and the height extenders are preferably about four tenths to six tenths of an inch thick but may be any desired thickness depending upon the application. The knee extension pads 40 and 42 preferably include slots or sockets 48 for receiving downward extending lugs 46 in knee extension pads 42 and 44 to provide alignment and adhering of the pads to one another. The knee extension pad show in FIG. 18 includes a concave center portion for supporting the underside of the leg opposite the knee.

Examples of exercise instructions to be followed in therapy sessions using the knee exercise system 10. As set forth hereafter. The following examples describe preferred embodiments of the invention. Other embodiments within the scope of the claims herein will be apparent to one skilled in the art from consideration of the specification or practice of the invention as disclosed herein. It is intended that the specification, together with the examples, be considered exemplary only, with the scope and spirit of the invention being indicated by the claims which follow the examples. In the examples all percentages are given on a weight basis unless otherwise indicated.

Set-Up for Knee Flexion Exercises

Knee Flexion Range Of Motion Goal: 110 degrees (or as Set By Your Physician or Therapist)

A firm chair is used with the back of the chair positioned against a wall or counter or other immovable object. Position the knee exercise device 10 on the floor with the black marker lines in line with the edge 60 of the chair 59 so that the main board extends out in front as shown in FIGS. 8-9.

The user sits close to the edge of the chair and the foot of the injured leg is placed on top of the foot board with the flexion pointer bar next to the foot board.

The knee exercise is equipped with two flexion targets (markers), one on each side of the main board. Coordinate the setting of the flexion targets with the physical therapist and determine the short term and long term goals. (An example would be setting the left flexion target for a two week goal and the right flexion target for a four week goal).

The goal is to push the flexion pointer bar in line with or past the flexion target. As the flexion pointer bar is pushed further back, it is possible to quantify the progress in flexing the operated knee.

EXAMPLE 1

Seated Foot Slides for Knee Flexion Range of Motion (Active Knee Flexion)—Flexion Goal 110-120 Degrees As illustrated in FIGS. 8-11, slide foot board is moved back and forth with the injured or rehabilitating leg pushing the Flexion Pointer Bar toward the Flexion Target. Keep the hip down on the chair especially when sliding the foot board toward the chair. Repeat the procedure the recommended number of times recording the repetitions and times a day.

Bend the injured leg by sliding the sliding foot board as fr forward as possible. Assist the knee flexion by pushing with the lower back and using the unaffected leg. Hold the stretch for a selected number of seconds repeating the exercise. The user should continue to aim on pushing the flexion pointer bar even with or pass the flexion target set by the physical therapist.

This exercise increases knee flexion and at the same time strengthens the hamstring muscle.

EXAMPLE 2

Seated Foot Slides for Assisted Knee Flexion Stretching

While the patient is sitting in a chair with the affected foot resting on the slidable foot board, the unaffected leg is positioned in front of the affected leg and the unaffected leg pushes the affected leg backward toward the chair holding the position for 20 to 20 seconds.

EXAMPLE 3

Active Knee Extension Stretching with Ankle Platform (Knee Extension Range of Motion Goal: 0 Degree (or Set By Doctor))

The sliding board base 12 is positioned on a bed or couch or other level elevated surface.

The ankle platform or tower is placed under the heel of the rehabilitating leg. The quad muscle is tightened and simultaneously the knee is pushed downward. The leg is relaxed allowing gravity to stretch the knee toward extension. The exercise is performed stretching the rehabilitating leg for the recommended rehabilitation time for a selected number of minutes for a selected times a day.

As illustrated in FIGS. 13, the rehabilitating leg is bent and supported with the tower or platform .providing a short-arc quad exercise. Continue to push the Flexion Pointer Bar to level or pass the Flexion Target set by your physical therapist.

EXAMPLE 4

Passive Knee Extension Stretching (Knee Extension Range of Motion Goal: 0 Degree (or Set By Doctor)

With the patient in the lying position the ankle platform is attached to the sliding foot board and the patient positions ankle of the affected leg on to of the platform. The patient relaxes the leg and leaves it in position for 5 to 30 minutes depending upon the patient's tolerance. Gravity stretches the patient's knee toward extension. Additional weight can be added to the top of the knee for adding stretching force.

EXAMPLE 5

Active Knee Extension with Removable Knee/Ankle Platform

Position the knee extension tower platform directly under the bend of the operated knee. The knee is pushed down against the platform which provides an extension target. Attempt to straighten the rehabilitated knee with repeated movements removing the top most layer as the rehabilitation progresses in order to further bend the knee and extend the leg. The layered platform extension blocks enable the user to quantify how much extension progress has been gained. The exercise is repeated for a selected number of repetitions for a selected number of days.

For instance three layers of the knee extension target platform on the proximal end of the slide board. With the patient in the lying position, the knee is positioned with the bend directly above the knee extension target platform. The patient tightens the quadriceps (thigh muscles) and simultaneously extends the knee to push the bend of the knee toward the extension target and holds the position for 5 to 10 seconds repeating the motion for 10 to 20 cycles. When the patient easily touches the upper layer of the extension target, remove a layer and repeat the procedure.

The sliding knee board device can also be equipped with a digital wireless goniometer whereby readings are wirelessly monitored through an application on a computerized smart device such as a smart phone, smart watch, smart pad, personal computer, tablet or the like. Smart devices include smart phones which include an advanced mobile operating system which combines features of a personal computer operating system with other features useful for mobile or handheld use. It typically combine the features of a cell phone with those of other popular mobile devices, such as personal digital assistant (PDA), media player and GPS navigation unit. Most smart phones can access the Internet, have a touchscreen user interface, can run third-party apps, music players and are camera phones. Most Smart phones produced from 2012 onwards also have high-speed mobile broadband 4G LTE internet, motion sensors, and mobile payment mechanisms. The term "smart device" includes smart phones and other computerized devices including display, transmitting, and receiving means such as a visual screen, keyboard, and audio and/or visual communication with the internet or other smart devices will be referred herein as a "smart device". Sensors positioned at selected positions on the base 12 or sliding board 18 in wireless communication with a smart device provide a means for recording and measuring the rehabilitative progress of the user. The sensors may be used to count the number of repetitions or pressure, or distance or combination thereof and transmitted to a receiver in the smart device and/or the sensor may include a microprocessor unit or other stand alone digital device. The counter may also be in wireless electrical communication with a pedometer or counter in order to count repetitions. The braces or sliding boards will have attached or built in digital goniometer so patients are able to monitor their progress toward a specific motion. The benefit to the patient is the ability to visually monitor the actual range of motion of the affected joint(s).

The foregoing detailed description is given primarily for clearness of understanding and no unnecessary limitations are to be understood therefrom, for modification will become obvious to those skilled in the art upon reading this disclosure and may be made without departing from the spirit of the invention and scope of the appended claims. Accordingly, this invention is not intended to be limited by the specific exemplification presented herein above. Rather, what is intended to be covered is within the spirit and scope of the appended claims.

We claim:

1. A knee flexion and extension therapy device comprising:

a generally rectangular slide board base having a front end and a rear end, said generally rectangular slide board having an upper flat surface with guide means comprising a rim extending around the periphery thereof defining a pair of marginal walls extending upwards from two longer sides of said generally rectangular slide board, said upward extending marginal walls having vertical sides, said outer vertical sides including a horizontal longitudinal slot, said generally rectangular slide board also including two movable target indices defining a flexion target and an extension target slidably engaging a respective one of said longitudinal slots, said upward extending marginal walls having fixed index marks;

a foot board resting horizontally on said flat upper surface of said slide board is slidably received between said upward extending marginal walls;

said slide board including longitudinal guide means for slidable cooperative engagement with the foot board for guiding selected from the group consisting of at least one ridge, at least one slot, at least one groove, a plurality of slots, and a plurality of grooves formed in said upper flat surface of said slide board;

a movable pointer slidably received between said upward extending marginal walls of said generally rectangular slide board, slidably disposed in said the longitudinal guide means positioned between said foot board and a rear portion of said slide board;

a knee/ankle support including a base, a vertical tower and a knee/ankle supporting pad affixed to a top of said tower, said base including means for slidable cooperative engagement with said longitudinal guide means;

said vertical tower including a variable vertical extension between an underside of a user's knee and a supporting surface of said foot board, said vertical tower having a selected effective height of less than the height of said user's knee bent with the foot and hip of the user positioned horizontally with respect to said slide board for 50 to 80 degrees of knee extension and from 0 to 110 degrees or greater knee flexion during knee rehabilitation; and said foot board having a top surface capable of supporting a foot of a user and including means for receiving and cooperatively engaging said means for slidable cooperative engagement of said base of said knee/ankle support.

2. The knee flexion and extension therapy device defined in claim 1 wherein a first one of said two movable target indices contains a movable pointer sensor which is electrically connected to a control box, said control box including a light capable of being activated by said movable pointer sensor when said movable pointer comes in close proximity to said sensor.

3. The knee flexion and extension therapy device defined in claim 2 wherein said knee extension pad contains a pressure sensor which is electrically connected to said control box, said control box including a light capable of being activated by said pressure sensor when a user's knee presses against said knee extension pad.

4. The knee flexion and extension therapy device defined in claim 1 wherein a first one of said two movable target indices contains a movable pointer sensor which is electrically connected to a control box, said control box including an audible alarm capable of being activated by said movable pointer sensor when said movable pointer comes in close proximity to said sensor.

5. The knee flexion and extension therapy device defined in claim 4 wherein said knee extension pad contains a pressure sensor which is electrically connected to said control box, said control box including an audible alarm capable of being activated by said pressure sensor when a user's knee presses against said knee extension pad.

6. A knee flexion and extension therapy device comprising:

a generally rectangular slide board having a front end and a rear end, said generally rectangular slide board having an upper flat surface with a pair of marginal walls extending upwards from two longer sides of said generally rectangular slide board, said upward extending marginal walls having outer vertical sides, said generally rectangular slide board including at least one longitudinal slot and movable target indices slidably engaging at least one of said at least one longitudinal slot, said upward extending marginal walls having indexing means at selected positions along said generally rectangular slide board;

a generally rectangular foot board resting horizontally on said flat upper surface of said slide board is slidably received between said upward extending marginal walls;

said slide board including longitudinal guide means for slidable cooperative engagement with the foot board for guiding selected from the group consisting of at least one ridge, at least one slot, at least one groove, a plurality of slots, and a plurality of grooves formed in said upper flat surface of said slide board; and said foot board having a top surface capable of supporting a foot of a user and including means of receiving and cooperatively engaging means for removably holding a knee/ankle support member.

7. The knee flexion and extension therapy device of claim 6, wherein said foot board including a top surface capable of supporting a foot of a user and including means for holding slots capable of receiving and cooperatively engaging at least one downward extending lug of said knee/ankle support.

8. The knee flexion and extension therapy device of claim 6, said knee/ankle support including a knee extension pad of a selected thickness.

9. The knee flexion and extension therapy device of claim 6, said knee/ankle support including a base, a vertical tower and a knee/ankle supporting pad affixed to a top of said tower, said base including downward extending lugs.

10. The knee flexion and extension therapy device of claim 6, including a movable pointer slidably captured between said upward extending marginal walls of said generally rectangular slide board, said movable pointer placed at a rear end of said foot board.

11. The knee flexion and extension therapy device of claim 6, including a movable pointer slidably cooperatively slidably engageable with said captured between said upward extending marginal walls of said generally rectangular slide board, said movable pointer placed at a rear end of said foot board.

12. The knee flexion and extension therapy device of claim 6 including a foot board and slide board friction enhancing means comprising threaded member extending from said foot board through said at least one longitudinal slot cooperatively engaging a tension knob for tightening said foot board against said slide board enhancing friction therebetween and creating adjustable slidable tension.

13. A knee flexion and extension therapy device comprising:

a generally rectangular slide board having a front end and a rear end, said generally rectangular slide board having an upper flat surface with a pair of marginal walls extending upwards from two longer sides of said generally rectangular slide board, said upward extending marginal walls having outer vertical sides, said generally rectangular slide board including at least one longitudinal slot and movable target indices slidably engaging at least one of said at least one longitudinal slot, said upward extending marginal walls having indexing means at selected positions along said generally rectangular slide board;

said slide board including longitudinal guide means for slidable cooperative engagement with said foot board for guiding selected from the group consisting of at least one ridge, at least one slot, at least one groove, a plurality of slots, and a plurality of grooves formed in said upper flat surface of said slide board;

a generally rectangular foot board slidably captured between said upward extending marginal walls in sliding cooperative engagement with said longitudinal slot; and said foot board resting horizontally on said flat upper surface of said slide board having a top surface capable of supporting a foot of a user and including means of receiving and cooperatively engaging means for removably holding a knee/ankle support member.

14. The knee flexion and extension therapy device of claim 13, wherein said foot board including a top surface capable of supporting a foot of a user and including means for holding slots capable of receiving and cooperatively engaging at least one downward extending lug of said knee/ankle support.

15. The knee flexion and extension therapy device of claim 13, said knee/ankle support including a knee extension pad of a selected thickness.

16. The knee flexion and extension therapy device of claim 13, wherein each of said outer vertical sides include at least one horizontal longitudinal slot.

17. The knee flexion and extension therapy device of claim 13, said knee/ankle support including a base, a vertical tower and a knee/ankle supporting pad affixed to a top of said tower, said base including downward extending lugs.

18. The knee flexion and extension therapy device of claim 13, including a movable pointer slidably captured between said upward extending marginal walls of said generally rectangular slide board, said movable pointer placed at a rear end of said foot board.

19. The knee flexion and extension therapy device of claim 13, including a movable pointer slidably cooperatively slidably engageable with said captured between said upward extending marginal walls of said generally rectangular slide board, said movable pointer placed at a rear end of said foot board.

20. A knee flexion and extension therapy device comprising:

a generally rectangular slide board having a front end and a rear end, said generally rectangular slide board having an upper flat surface with a pair of marginal walls extending upwards from two longer sides of said generally rectangular slide board, said upward extending marginal walls having outer vertical sides, at least one of said outer vertical sides including a horizontal longitudinal side slot, said generally rectangular slide board also including at least one movable target indices slidably engaging said at least one longitudinal side slot, said upward extending marginal walls having indicia means at selected points of said generally rectangular slide board for aligning said slide board with a user's chair;

a generally rectangular foot board slidably captured between said upward extending marginal walls;

a movable pointer slidably captured between said upward extending marginal walls of said generally rectangular slide board, said movable pointer placed rearward of said foot board;

a knee/ankle support including a base removably supported and cooperatively engaging said generally rectangular slide board; and said foot board resting horizontally on said flat upper surface of said slide board having a top surface capable of supporting a foot of a user and including slots capable of receiving and cooperatively engaging means for holding said knee/ankle support.

21. The knee flexion and extension therapy device of claim 20, said knee/ankle support including a base, a vertical tower and a knee/ankle supporting pad affixed to a top of said tower, said base including downward extending lugs.

22. The knee flexion and extension therapy device of claim 20, wherein said knee extension pad includes at least one height extending pad.

* * * * *